US010890423B2

(12) United States Patent
Stadelmann

(10) Patent No.: US 10,890,423 B2
(45) Date of Patent: Jan. 12, 2021

(54) PROJECTILE WITH PENETRATOR

(71) Applicant: saltech AG, Daniken (CH)

(72) Inventor: Roger August Stadelmann, Fulenbach (CH)

(73) Assignee: saltech AG, Daniken (CH)

( * ) Notice: Subject to any disclaimer, the term of this patent is extended or adjusted under 35 U.S.C. 154(b) by 0 days.

(21) Appl. No.: 16/329,842

(22) PCT Filed: Sep. 1, 2017

(86) PCT No.: PCT/EP2017/071973
§ 371 (c)(1),
(2) Date: Mar. 1, 2019

(87) PCT Pub. No.: WO2018/042000
PCT Pub. Date: Mar. 8, 2018

(65) Prior Publication Data

US 2019/0242680 A1 Aug. 8, 2019

(30) Foreign Application Priority Data

Sep. 2, 2016 (EP) ..... 16187018

(51) Int. Cl.
*F42B 12/06* (2006.01)

(52) U.S. Cl.
CPC ..... *F42B 12/06* (2013.01)

(58) Field of Classification Search
CPC ..... F42B 12/06
USPC ..... 102/518
See application file for complete search history.

(56) References Cited

U.S. PATENT DOCUMENTS 3,782,287 A * 1/1974 Sie ..... F42B 12/78 102/516
5,009,166 A * 4/1991 Bilsbury ..... F42B 12/78 102/516
6,085,661 A * 7/2000 Halverson ..... F42B 12/74 102/516
6,374,743 B1 * 4/2002 Hug ..... F42B 12/74 102/518
7,918,164 B1 * 4/2011 Eberhart ..... F42B 12/78 102/516

(Continued)

FOREIGN PATENT DOCUMENTS

EP 0343389 A1 11/1989
IL 79191 A 1/1991

(Continued)

*Primary Examiner* — Samir Abdosh
(74) *Attorney, Agent, or Firm* — The Webb Law Firm

(57) ABSTRACT

The invention relates to a projectile (1, 1') comprising a retaining element (2, 2') and a penetrator (3). The penetrator (3) is at least partly received in a retaining element (2, 2') receiving opening (12, 12') which runs centrally relative to the projectile axis (A) and has a penetrator front (4) and a penetrator rear (5). The penetrator rear (5) has a cylindrical shape, and the penetrator front (4) runs in a conical manner from the penetrator rear (5) in the direction of a penetrator tip (6) with respect to the projectile axis (A). The length ratio of the length (LPF) of the penetrator front (4) to the length (LPH) of the penetrator rear (5) is approximately 1 to 1, preferably approximately 1 to 1.5, particularly preferably approximately 1 to 2.2.

24 Claims, 2 Drawing Sheets

(56) References Cited

U.S. PATENT DOCUMENTS

| | | | | |
|---|---|---|---|---|
| 7,980,180 | B2 * | 7/2011 | MacDougall | F42B 12/06 102/514 |
| 9,709,368 | B2 * | 7/2017 | Mahnke | F42B 12/06 |
| 10,578,410 | B2 * | 3/2020 | Mahnke | F42B 12/06 |
| 2007/0017409 | A1 * | 1/2007 | Mansfield | F42B 12/06 102/518 |
| 2007/0163459 | A1 * | 7/2007 | MacDougall | F42B 12/06 102/514 |
| 2016/0153757 | A1 * | 6/2016 | Mahnke | F42B 10/46 102/501 |

FOREIGN PATENT DOCUMENTS

| | | | |
|---|---|---|---|
| WO | 9741404 | A1 | 6/1997 |
| WO | 2006010424 | A1 | 2/2006 |

* cited by examiner

PROJECTILE WITH PENETRATOR

CROSS-REFERENCE TO RELATED APPLICATIONS

This application is the United States national phase of International Application No. PCT/EP2017/071973 filed Sep. 1, 2017, and claims priority to European Patent Application No. 16 187 018.3 filed Sep. 2, 2016, the disclosure of each of which is hereby incorporated by reference in its entirety.

BACKGROUND OF THE INVENTION

Field of the Invention

The present application relates to a projectile and, in particular, to a projectile with a penetrator.

Description of Related Art

A hard-core bullet or kinetic energy bullet is understood to be a projectile with high penetrating power, which has an armor piercing action. Such bullets are used in particular by marksmen and aim to achieve precise penetration of armored targets, for example personal body armor, bullet-proof glass, steel plates or light metal armor. In these bullets, the kinetic energy of the projectile thereof is used to penetrate the target surface, and so it is possible to dispense with explosive material or a detonator in the bullet itself. The term penetrator is therefore a common designation for the projectile. Bullets that have a core with a jacket are known as jacketed bullets. The jacket protects the barrel and also prevents any deformation or fragmentation of the core upon striking a target object. While full metal jacket bullets entirely surround the core and allow high bullet speeds, the core in semi-jacketed bullets is not enclosed by jacket material at the tip, and so, upon striking a target object, the less stable tip of the bullet is deformed by the high pressure upon impact and upon penetrating the target, and causes effective energy release in the target object. Such ammunition is known in various designs.

Thus, WO 97/41404 discloses a small caliber bullet having a bullet core made of a hard and heavy material, wherein the bullet core is arranged within a hollow bullet jacket.

U.S. Pat. No. 3,782,287 discloses an armor piercing bullet having a bullet jacket, wherein a hard metal core and a filling material are arranged in the bullet jacket.

U.S. Pat. No. 6,374,743 B1 discloses a small caliber bullet having a hard core arranged on the front side and a soft core arranged on the rear side. The small caliber bullet has a jacket made of steel, plated steel or brass.

WO 2006/010424 discloses a hard-core bullet, which has a bullet core. Inserted into the bullet core is a penetrator, which projects out of the bullet core.

On account of their geometry and their ballistic properties, many of the bullets known from the prior art have an insufficient penetrating power or hit probability with respect to the armored target object.

SUMMARY OF THE INVENTION

Therefore, it is an object of the invention to provide a bullet that overcomes the drawbacks of the prior art. A particularly preferred object is to provide a bullet that has a high penetrating power and increased precision.

Therefore, a bullet comprising a retaining element and a penetrator is provided, wherein the penetrator is received at least partially in a receiving opening, extending centrally relative to the bullet axis, of the retaining element, and has a penetrator front and a penetrator rear. The penetrator rear is formed in a cylindrical manner and the penetrator front is formed in a manner tapering conically toward the bullet axis starting from the penetrator rear in the direction of a penetrator tip. The length of the penetrator front is in a length ratio of about 1 to 1, preferably about 1 to 1.5, particularly preferably about 1 to 2.2, with respect to the length of the penetrator rear.

In other words, the penetrator has a cylindrical rear and a conical or tapered front, wherein the rear is longer than the front as seen along the bullet axis. A conical or tapered front is understood as meaning in particular that the front is conical or tapered in the geometrical sense. This means that the outer surface extends preferably at a constant angle to the central axis of the penetrator.

Preferably, the cylindrical penetrator rear and the conical penetrator front are formed with a weight ratio of about 2 to 12, preferably of about 4 to 10, with respect to one another. In other words, it is preferred for the cylindrical penetrator rear to have a weight that is about 2 to 12 times greater, preferably about 4 to 10 times greater, than the weight of the conical penetrator front.

These weight distributions bring about increased precision.

Preferably, the penetrator front has a cone angle of between 10° and 20°, preferably 13°. This means that the penetrator front tapering conically from the penetrator rear in the direction of the penetrator tip has a diameter that becomes smaller in this direction, such that the penetrator front has a smaller diameter in its front region than in its rear region.

The penetrator tip can have a flat end face, which extends perpendicularly to the bullet axis. Alternatively, the penetrator can have a pointed end.

Therefore, the conically tapering penetrator front leads preferably to a penetrator tip that forms a straight angle. This means that the penetrator tip can be what is known as a flat tip. The diameter of the penetrator tip is preferably between about 0.4 and 1.2 mm, particularly preferably about 0.8 mm.

Preferably, the total length of the penetrator is between 35 mm and 55 mm, preferably 45 mm, and/or the length of the penetrator front is between 12 mm and 17 mm, preferably 14 mm, and/or the length of the penetrator rear is between 15 mm and 44 mm, preferably 31 mm.

The diameter of the penetrator rear is preferably between 6 mm and 9 mm, preferably 7 mm.

Preferably, the total length of the penetrator, i.e. the sum of the length of the penetrator front and the length of the penetrator rear, and the diameter of the penetrator rear are in a ratio of about 4 to 10, preferably of about 5 to 9, to one another. In other words, it is preferred for the total length of the penetrator to be about 4 to 10 times longer, preferably about 5 to 9 times longer, than the diameter of the penetrator rear.

These length ratios have a positive effect on the penetration performance, meaning that the penetrator obtains a high penetrating power and can travel further in a target object before it is stopped.

The penetrator is preferably formed in one piece from the penetrator front and the penetrator rear, and consists preferably of a material with a higher density than the retaining element, in particular of tungsten carbide.

A large impact force on the target object and an armor piercing action can be achieved by the penetrator consisting of a material with a high density, which confers high strength and hardness on the penetrator. Thus, the penetrator consists preferably of an alloy of which the main constituent is tungsten, for example tungsten carbide. However, it is also possible for the penetrator to consist of a single element, for example tungsten.

In a penetrator formed in one piece, the penetrator front and the penetrator rear are therefore not formed as separate components, but rather it is an integrally formed penetrator, the external shape of which, as seen from the penetrator tip, is formed with a conical shape and transitions into a cylindrical rear region.

According to a first embodiment, the penetrator, in particular the penetrator front, projects out of the front of the retaining element.

When such a bullet having a protruding penetrator strikes the target object, the penetrator immediately takes effect, wherein energy, which would be necessary for the deformation or fragmentation of the retaining element in the case of a completely covered penetrator, is available in its entirety to the penetrator.

Preferably, the penetrator rear is received with a precise fit in the receiving opening of the retaining element.

Thus, while the penetrator projects at the front out of the receiving opening in the retaining element, the rear region of the penetrator is received in the receiving opening. The penetrator can be fastened in the retaining element via a force-fitting connection, for example a press fit, in which the penetrator is pressed into the receiving opening in the retaining element. Preferably, the retaining element has, in the region of the retaining element middle, a plurality of notches with a reduced diameter. Further possible fastening methods are a material bond by soldering or adhesive bonding, or form-fitting fastening.

The retaining element preferably has a frustoconical retaining element rear, a cylindrical retaining element middle, and a retaining element front that is formed in a manner tapering conically toward the bullet axis starting from the retaining element middle in the direction of the penetrator tip. Preferably, the retaining element front forms an extension of the conical tip of the penetrator and extends in the same direction as the conical tip of the penetrator.

Preferably, the retaining element front has a cone angle of between 10° and 20°, preferably 13°, and/or the retaining element front has a wall thickness that decreases continuously in the direction of the penetrator tip and is preferably zero in the transition region between the penetrator front and the penetrator rear, such that the entire penetrator front is exposed.

In other words, there is preferably a seamless transition between the retaining element front and the penetrator front. The lateral surface of the penetrator front can thus be regarded as an extension along the bullet axis of the lateral surface of the retaining element front, said extension without a transition adjoining the lateral surface of the retaining element front. Such a configuration of the bullet outer surface results in good aerodynamic and ballistic properties.

Thus, preferably, the entire penetrator front projects out of the retaining element and already penetrates the target object before the retaining element strikes the target object, such that the bullet can release its kinetic energy very effectively to the target object. However, it is also possible for the retaining element front also to extend at least regionally over the penetrator rear, thereby leaving for example both the penetrator tip and a part of the penetrator rear uncovered.

Preferably, the retaining element rear has a frustum angle of between 5° and 15°, preferably 9°, and/or the diameter at the frustum end of the retaining element rear is preferably between 9 mm and 11 mm, preferably 10 mm, and/or the retaining element rear preferably has a conical indentation.

The conical indentation is located preferably in the rear region of the retaining element rear and serves to improve the flight characteristics of the bullet by stabilization.

Preferably, the diameter of the retaining element middle is between 12.5 mm and 13.5 mm, preferably 12.98 mm, and/or the lateral surface of the retaining element middle preferably has encircling grooves. The grooves can be arranged in a rear region of the retaining element middle. However, it is also conceivable for only a front region of the retaining element middle or the entire retaining element middle to be provided with grooves. In particular, about one third to half the lateral surface, as seen from the rear end in the direction of the front end of the retaining element middle, is provided with grooves. In this case, preferably two or more grooves are provided, which are formed immediately next to one another in the lateral surface of the retaining element middle, starting from the rear end of the retaining element middle in the direction of the front end of the retaining element middle. It is possible for the grooves to each be arranged at the same spacing from one another on the lateral surface. Alternatively, however, the grooves can also be at different spacings from one another. For example, four grooves can be provided, wherein the spacing between two adjacent grooves becomes increasingly large from the rear end in the direction of the front end of the retaining element middle. Alternatively, the first two grooves with regard to the rear end of the retaining element middle can be arranged at a first spacing from one another and the last two grooves with regard to the rear end of the retaining element middle can be arranged at a second spacing from one another, which is greater or smaller than the first spacing. In addition, it is conceivable for the grooves to each have an identical groove profile, i.e. to have the same groove depth or to extend into the lateral surface by the same amount, and to have the same groove shape. Conceivable groove shapes are for example semicircular or U-shaped grooves or rectangular grooves. A semicircular, U-shaped or rectangular groove is understood as being a groove that delimits a semicircular, U-shaped or rectangular cutout. However, it is also possible for the grooves to each have different groove profiles. In addition to the same or different geometrical shapes of the cutout, the clearance of the cutout can also be the same or different in each case.

The groove depth is preferably between 0.5 mm and 2.0 mm, in particular 1.5 mm, and/or the clear width of the grooves is preferably between 1.0 mm and 2.0 mm, in particular 1.6 mm, and/or the spacing between two adjacent grooves is preferably between 1 mm and 2 mm, in particular 1.2 mm. Put another way, the groove depth is preferably about one third of the clear width up to twice the clear width, in particular half the clear width up to one times the clear width of the cutout. The spacing between two adjacent grooves is preferably half the clear width up to twice the clear width, and in particular the spacing corresponds approximately to the clear width.

The encircling grooves are configured to interact with correspondingly formed rifling in a gun barrel and serve to reduce the friction of the bullet in the gun barrel, cause less barrel erosion and thus increase the life span of the weapon. Together with the other configuration of the bullet, in particular on account of the penetrator, the grooves also serve to increase performance. Thus, the friction reduction of the grooves and the material hardness and mass of the penetrator have the effect that the bullet strikes a target with high penetrating power and can penetrate for example steel plates.

The retaining element is preferably formed in one piece from the retaining element rear, the retaining element middle, and the retaining element front, and consists preferably of brass and/or brass alloys.

In a retaining element formed in one piece, similarly to the penetrator formed in one piece, the retaining element front, the retaining element middle, and the retaining element rear are thus not formed as different components but rather integrally, wherein the external shape of the retaining element, as seen from the penetrator tip, is formed with a conical shape and transitions into a cylindrical middle region and then into a frustoconical rear region.

The total length of the retaining element is preferably between 35 mm and 55 mm, preferably 43 mm, and/or the length of the retaining element front is preferably between 3 mm and 21 mm, preferably 13 mm, and/or the length of the retaining element middle is preferably between 14 mm and 42 mm, preferably 21 mm.

Preferably, for a total bullet mass of 100%, the retaining element makes up 60% and the penetrator makes up 40% thereof.

These length ratios and mass distribution result, for the present bullet with a protruding penetrator, in an ideal weight distribution, wherein the center of gravity of the bullet is optimal for a ballistic trajectory.

According to a second embodiment, the penetrator is received preferably entirely, and in particular with a precise fit, in the retaining element.

In other words, the penetrator completely fills the receiving opening in the retaining element.

Preferably, the retaining element has a frustoconical retaining element rear, a cylindrical retaining element middle, and an ogival retaining element front, wherein the retaining element front transitions into a frustum shape or calotte shape in its front region.

Preferably, the retaining element front, the retaining element middle, and at least regionally also the retaining element rear are encased by a casing, wherein the casing consists preferably of brass.

In the case of an only regionally encased retaining element rear, it is possible for example for the rear region of the retaining element rear to be casing-free. Instead of an only regionally encased retaining element rear, a completely encased retaining element rear, i.e. a retaining element that is fully encased as a whole, is also possible. The casing is preferably configured such that it has the respective shape of the encased retaining element region, namely ogival, cylindrical or frustoconical, respectively. It is preferred here for the casing to immediately adjoin the retaining element and thus to have been applied directly thereto. By way of a casing resting on the retaining element in a form-fitting manner, it is possible for a compact, rotationally symmetric and dimensionally accurate bullet to be provided, which has good penetration characteristics.

The casing preferably has a greater wall thickness in the front region of the retaining element front, and/or the casing preferably has a notch in the region of the retaining element middle, and/or the casing preferably has rear-side flanging in the region of the retaining element rear, and/or the casing preferably encloses an air space with the retaining element rear in the region of the retaining element rear.

The notch can interact with correspondingly formed rifling in a gun barrel and serves to reduce the friction of the bullet in the gun barrel.

The front thickening of the casing reduces ricochets when hard target objects are being fired on at an oblique angle and also serves to fix the center of mass of the bullet.

Preferably, the retaining element middle has at its front a frustum with a cone angle of between 30° and 50°, preferably 45°, and the retaining element front preferably has at its rear an internal cone with an identical cone angle and has been fitted in a form-fitting manner on the frustum. These cone angles allow optimal rotationally symmetric centering of the retaining element front on the retaining element middle and thus also of the penetrator received therein.

Preferably, the retaining element middle extends beyond the middle of the penetrator starting from the penetrator rear in the direction of the penetrator front, and/or the retaining element front extends beyond the penetrator tip. In other words, the penetrator tip is entirely surrounded by the retaining element front.

Preferably, the retaining element rear and the retaining element middle are formed in one piece and consist of a plastic, in particular PET, or steel, and/or the retaining element front consists of pulverulent substances or mixtures such as borax, incendiary agents or explosives.

In this case, the retaining element rear and the retaining element middle are thus formed integrally, while the retaining element front is a component formed separately therefrom. While the penetrator consists of a material with a very high density, the retaining element comprises a material or materials with a lower density than the penetrator.

The total length of the retaining element is preferably between 53 mm and 55 mm, preferably 54 mm, and/or the length of the retaining element front is preferably between 22 mm and 28 mm, preferably 26 mm, and/or the length of the retaining element middle is preferably between 19 mm and 25 mm, preferably 21 mm.

Preferably, for a total bullet mass of 100%, the retaining element makes up 10%, the penetrator makes up 50%, and the casing makes up 40% thereof, and/or preferably, for a total retaining element mass of 100%, the retaining element front makes up 40%, the retaining element middle makes up 50%, and the retaining element rear makes up 10% thereof.

These length ratios and mass distribution result, for the present, encased bullet with fully received penetrator, in an ideal weight distribution, wherein the center of gravity of the bullet is optimal for a ballistic trajectory.

BRIEF DESCRIPTION OF THE DRAWINGS

Preferred embodiments of the invention are described in the following with reference to the drawings, which serve merely for explanation and should not be interpreted as being limiting. In the drawings.

DESCRIPTION OF PREFERRED EMBODIMENTS

Figure 1:
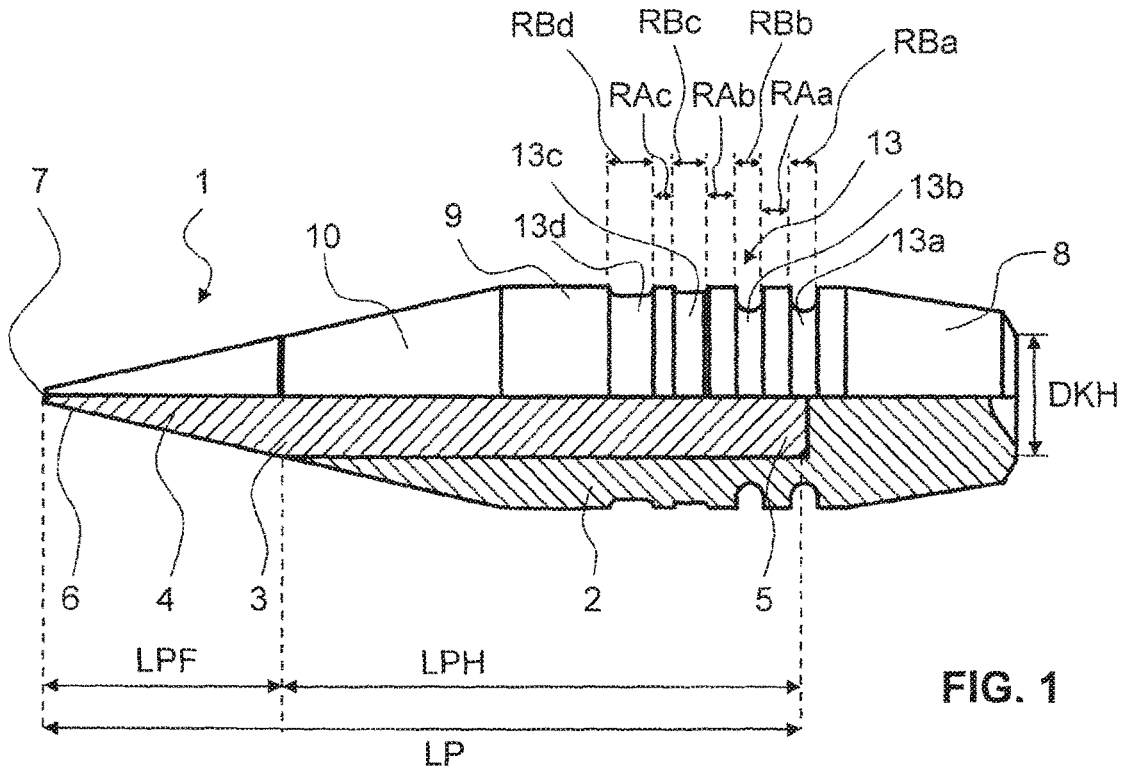
FIG. 1 shows a view in partial section through a bullet according to a first embodiment.

FIGS. 1 to 4 each show a bullet 1, 1' comprising a retaining element 2, 2' and a penetrator 3, which has a penetrator front 4 and a penetrator rear 5. The penetrator rear 5 is formed in a cylindrical manner and the penetrator front 4 is formed in a manner tapering conically toward the bullet axis A starting from the penetrator rear 5 in the direction of a penetrator tip 6. In these figures, the length ratio between the length LPF of the penetrator front 4 with regard to the length LPH of the penetrator rear 5 is about 1 to 2, i.e. the penetrator rear is longer than the penetrator front by around a factor of two. In particular, in this case, the total length LP of the penetrator 3 is 45 mm, wherein the length LPF of the penetrator front 4 is 13 mm, and the length LPH of the penetrator rear 5 is 32 mm.

Figure 2:
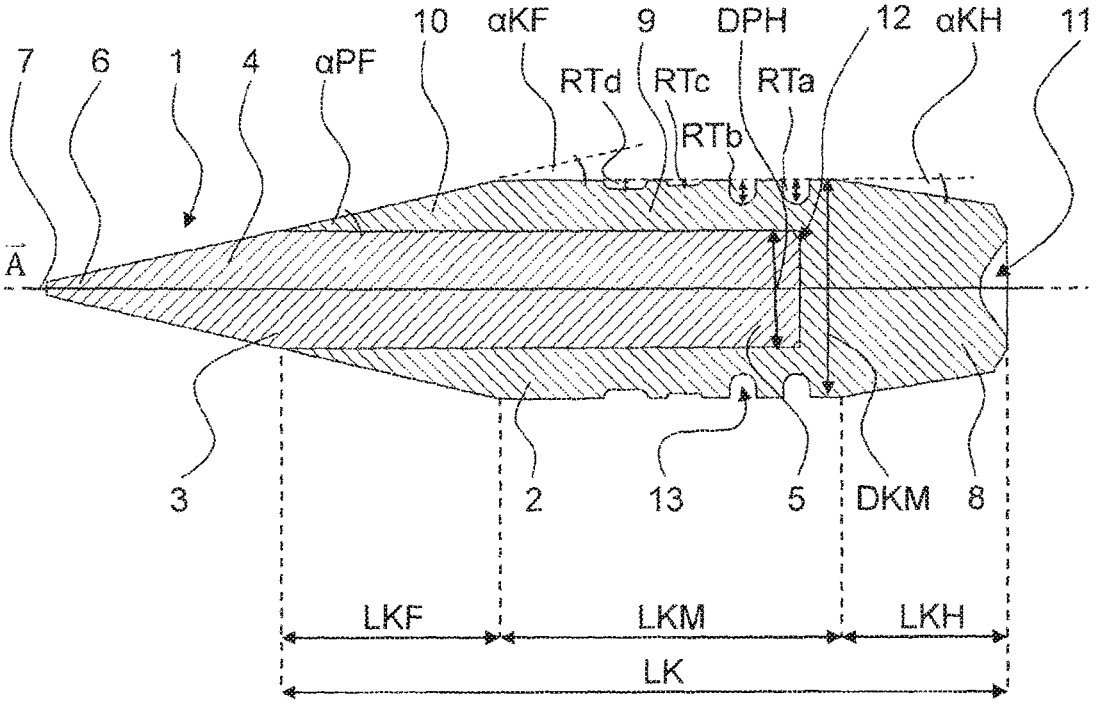
FIG. 2 shows a view in full section through the bullet according to FIG. 1.
Figure 3:
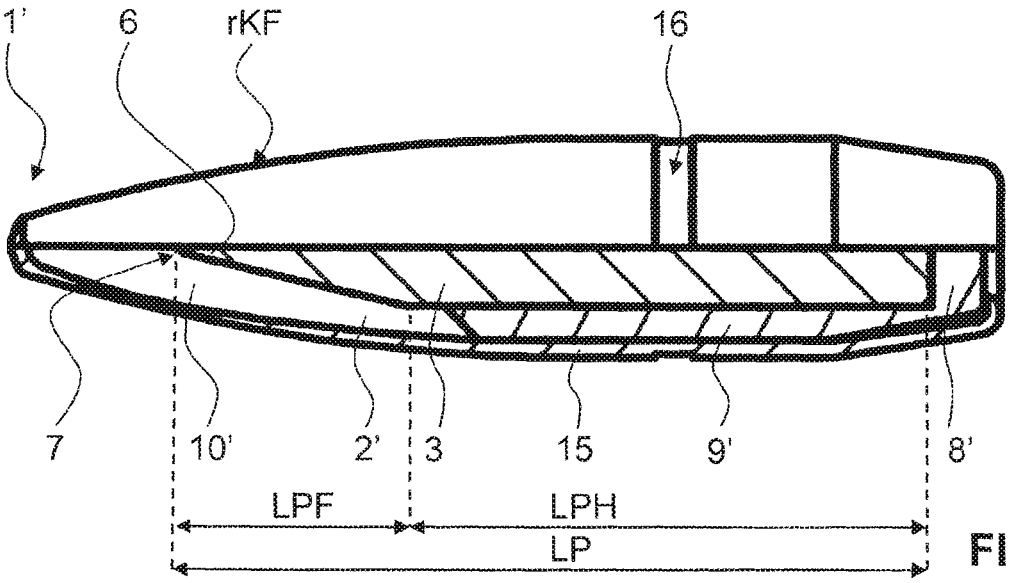
FIG. 3 shows a view in partial section through a bullet according to a second embodiment.
Figure 4:
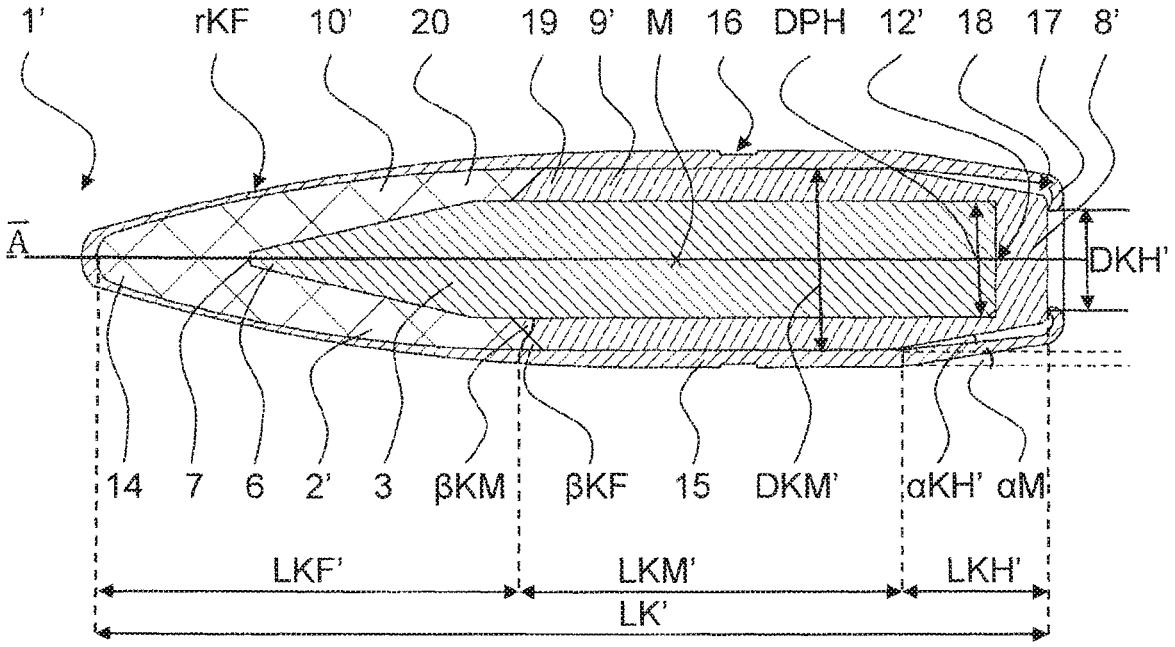
FIG. 4 shows a view in full section through the bullet according to FIG. 3.

FIGS. 1 and 2 illustrate a first embodiment of the bullet 1, in which the penetrator 3 is received at its rear only partially in a receiving opening 12, extending centrally with respect to the bullet axis A, of the retaining element 2, and at its front projects with the penetrator front 4 out of the retaining element 2. FIGS. 3 and 4 illustrate a second embodiment of the bullet 1', in which the penetrator 3 is fully received in the retaining element 2'. In FIGS. 1-4, identical components are provided with identical reference signs in each case.

In both embodiments, the penetrator front 4 has a cone angle αPF of about 13°, and the penetrator tip 6 has a flat end face 7, which extends perpendicularly to the bullet axis A. Furthermore, the diameter DPH of the penetrator rear 5 is about 7 mm. In both embodiments, the penetrator 3 is formed in one piece from the penetrator front 4 and the penetrator rear 5 and consists entirely of tungsten carbide.

As is apparent from FIGS. 1 and 2, the penetrator rear 5 in the bullet 1 according to the first embodiment is received with a precise fit in the receiving opening 12 of the retaining element 2, wherein the penetrator rear 5 has at its rear in the region of its base a notch with a reduced diameter.

The retaining element 2 has a frustoconical retaining element rear 8, a cylindrical retaining element middle 9, and a retaining element front 10, wherein the retaining element front 10 is formed in a manner tapering conically toward the bullet axis A starting from the retaining element middle 9 in the direction of the penetrator tip 6. The conical retaining element front 10 is in this case formed with a cone angle αKF of about 13° and has a wall thickness that narrows continuously in the direction of the penetrator tip 6 and is zero at the point of the transition from the penetrator front 4 to the penetrator rear 5. The entire penetrator front 4 is thus exposed. In this case, there is a seamless transition between the front retaining element front 10 and the rear penetrator front 4, such that the lateral surface of the penetrator front 4 can be regarded as an extension of the lateral surface of the retaining element front 10.

The frustoconical retaining element rear 5 has in this case a frustum angle αKH of about 9°, and the diameter DKH at the frustum end of the retaining element rear 8 is about 10 mm.

In addition, the retaining element rear 8 has at its rear a conical indentation 11, which extends centrally into the retaining element rear 8.

The retaining element middle 9 has a diameter DKM of about 13 mm, and regionally encircling grooves 13 are provided on the lateral surface of the retaining element middle 9, said grooves 13 being able to interact with correspondingly formed rifling in a gun barrel (not illustrated).

In the embodiment shown here, four grooves 13*a*, 13*b*, 13*c*, 13*d* are formed in the lateral surface of the retaining element middle 9, wherein the grooves 13*a*, 13*b*, 13*c*, 13*d* are arranged immediately next to one another along about half the lateral surface as seen from the rear end of the retaining element middle 9 in the direction of the front end of the retaining element middle 9. The first two grooves 13*a*, 13*b* as seen with regard to the rear end of the retaining element middle 9 are formed identically here. Thus, they both have the same U-shaped groove shape and extend with the same groove depth RTa, RTb into the lateral surface of the retaining element middle 9. The clearance of these grooves, that is to say, in addition to the groove depth RTa, RTb or clear height, also the clear width RBa, RBb, is also the same in each case. The spacing RTa between these two grooves 13*a*, 13*b* corresponds approximately to the groove depth RTa, RTb or clear height of these grooves 13*a*, 13*b*. In contrast thereto, the two further grooves 13*c*, 13*d* arranged following these two grooves 13*a*, 13*b* each have a rectangular groove shape and differ in their clearance both from the first two grooves 13*a*, 13*b* and from one another. In particular, the rectangular grooves 13*c*, 13*d* each have a smaller groove depth RTc, RTd than the U-shaped grooves 13*a*, 13*b*. In addition, the rectangular groove 13*c* arranged next to the U-shaped groove 13*b* extends into the lateral surface to a much lesser extent than is the case for the other rectangular groove 13*d*. While the rectangular groove 13*c* and the U-shaped groove 13*b* arranged next thereto are arranged at a spacing RAb from one another that corresponds approximately to the spacing RAa between the two U-shaped grooves, the spacing RAc between the two rectangular grooves 13*c*, 13*d* is, by contrast, much less. The groove depth RTa, RTb of the first and second U-shaped grooves 13*a*, 13*b* is in this case about one eighth of the diameter DKM of the retaining element middle. The groove depths RTc, RTd of the third groove 13*c*, which is arranged next to the U-shaped groove 13*b*, and of the fourth groove 13*d*, which is arranged next to the third groove 13*c*, are less than the diameter DKM of the retaining element middle by around a factor of 30 and 15, respectively.

However, it should be understood that the groove arrangement and the groove formation are not limited to the grooves shown herein. Rather, fewer or more than four grooves can be provided, which have the same or different groove profiles and/or are each arranged at the same or varying spacings from one another.

In FIGS. 1 and 2, the retaining element 2 is formed in one piece from the retaining element rear 8, the retaining element middle 9, and the retaining element front 10, and consists entirely of brass. The total length LK of the retaining element 2 is in this case about 46 mm, wherein the length LKF of the retaining element front 10 is about 14 mm, the length LKM of the retaining element middle 9 is about 22 mm, and the length LKH of the retaining element rear 8 is about 10 mm.

For a total bullet mass of 100%, the retaining element 2 makes up 60% and the penetrator 3 makes up 40% thereof. Thus, the bullet 1 consists here only of the retaining element 2 and the penetrator 3, and is formed in particular without a casing.

As already mentioned and as is apparent from FIGS. 3 and 4, in the bullet 1' according to the second embodiment, not just the penetrator rear 5 but also the penetrator front 4, i.e. the whole penetrator, is received entirely in the retaining element 2'.

Similarly to the retaining element 2 of the bullet 1, the retaining element 2' of the bullet 1' has a frustoconical retaining element rear 8' and a cylindrical retaining element middle 9'. In contrast to the conical retaining element front 10 of the bullet 1, however, the retaining element 2' of the bullet 1' has an ogival retaining element front 10', which transitions in its front region 14 into a calotte shape.

The diameter DKM' of the retaining element middle 9' is about 11 mm. The retaining element rear 8' has a frustum angle αKH' of about 9°, wherein the diameter DKH' at the frustum end of the retaining element rear 8' is about 8.5 mm. The retaining element middle 9' has at its front a frustum 19 with a cone angle βKM of about 45°, and the retaining element front 10' has at its rear an internal cone 20 with an identical cone angle βKF of about 45°, wherein the internal cone 20 has been fitted in a form-fitting manner on the frustum 19. The retaining element middle 9' extends beyond the middle M of the penetrator 3 starting from the penetrator rear 5 in the direction of the penetrator front 4, and the retaining element front 10' extends beyond the penetrator tip 6 in the same direction.

The retaining element rear 8' and the retaining element middle 9' are in this case formed in one piece and consist of PET or steel. The separately formed retaining element front 10' consists of borax. The total length LK' of the retaining element 2' is in this case about 54 mm, wherein the length LKF' of the retaining element front 10' is about 26 mm and the length LKM' of the retaining element middle 9' is about 21 mm.

Here too, the penetrator rear 5 of the bullet 1' has at its rear in the region of its base a notch with a reduced diameter and is received with a precise fit in a receiving opening 12' of the retaining element 2'. The receiving opening 12' extends centrally through the retaining element middle 9' into the retaining element rear 8'. The penetrator front 4 is received in a closely fitting recess in the retaining element front 10', which narrows increasingly from the penetrator rear 5 in the direction of the penetrator front 4. As a result of the internal cone 20 in the rear region of the retaining element front 10' and of the frustum 19 in the front region of the retaining element middle 9', the retaining element front 10' can be joined tightly together with the retaining element middle 9', and thus good fixing of the penetrator in the bullet 1' is allowed.

In addition, the retaining element front 10', the retaining element middle 9', and regionally also the retaining element rear 8' are encased by a casing 15, which has the respective shape of the encased retaining element 2', i.e. ogival in the front region, cylindrical in the middle region, and frustoconical in the rear region. The casing 15 in this case consists entirely of brass and rests directly on the lateral surface of the retaining element front 10' and of the retaining element middle 9'.

The casing 15 also regionally surrounds the retaining element rear 8' and in the process encloses, with the retaining element rear 8', an air space 18, which becomes increasingly large from the front region to the rear region of the retaining element rear 8'. The spacing between the casing 15 and the lateral surface of the retaining element rear 8' thus becomes increasingly large in this direction.

The casing 15 ends at the rear of the retaining element rear 8' in flanging 17 and in the process leaves a portion of the retaining element rear 8' free of casing. However, in this case, the penetrator 3 is never in contact with the casing 15. The casing 15 has, in the front region of the retaining element front 10', a greater wall thickness and has, in the region of the retaining element middle 9', a notch 16, which can interact with correspondingly formed rifling in a gun barrel (not illustrated).

For a total bullet mass of 100%, the retaining element 2' makes up 10%, the penetrator 3 makes up 50%, and the casing 15 makes up 40% thereof, wherein, for a total retaining element mass of 100%, the retaining element front 10' makes up 40%, the retaining element middle 9' makes up 50%, and the retaining element rear 8' makes up 10% thereof. The bullet 1' thus consists in this case of the retaining element 2', the penetrator 3, and the casing 15.

The invention claimed is:

1. A bullet comprising a retaining element and a penetrator, wherein the penetrator is received at least partially in a receiving opening, extending centrally relative to a bullet axis, of the retaining element, and has a penetrator front and a penetrator rear, wherein the penetrator rear is formed in a cylindrical manner and the penetrator front is formed in a manner tapering conically toward the bullet axis starting from the penetrator rear in the direction of a penetrator tip, wherein a length of the penetrator front is in a length ratio of 1 to 1, or 1 to 1.5, or 1 to 2.2, with respect to a length of the penetrator rear, wherein the retaining element comprises a retaining element rear, a retaining element middle, and a retaining element front, wherein the retaining element front, the retaining element middle, and at least regionally also the retaining element rear are encased by a casing, and wherein the casing encloses an air space with the retaining element rear in a region of the retaining element rear.

2. The bullet as claimed in claim 1, wherein at least one of:

i) the penetrator front has a cone angle of between 5° and 25°, and ii) the penetrator tip has a flat end face, which extends perpendicularly to the bullet axis.

3. The bullet as claimed in claim 1, wherein at least one of:

i) a total length of the penetrator is between 35 mm and 55 mm, and ii) the length of the penetrator front is between 12 mm and 17 mm, and iii) the length of the penetrator rear is between 15 mm and 44 mm, and iv) a diameter of the penetrator rear is between 6 mm and 9 mm.

4. The bullet as claimed in claim 1, wherein the penetrator is formed in one piece from the penetrator front and the penetrator rear, and consists of a material with a higher density than the retaining element.

5. A bullet comprising a retaining element and a penetrator, wherein the penetrator is received at least partially in a receiving opening, extending centrally relative to a bullet axis, of the retaining element, and has a penetrator front and a penetrator rear, wherein the penetrator rear is formed in a cylindrical manner and the penetrator front is formed in a manner tapering conically toward the bullet axis starting from the penetrator rear in the direction of a penetrator tip, wherein a length of the penetrator front is in a length ratio of 1 to 1, or 1 to 1.5, or 1 to 2.2, with respect to a length of the penetrator rear, wherein the retaining element comprises a retaining element front, wherein the penetrator projects out of the retaining element front, and wherein the retaining element front extends at least regionally over the penetrator rear, thereby leaving both the penetrator tip and a part of the penetrator rear uncovered.

6. The bullet as claimed in claim 5, wherein the penetrator rear is received with a precise fit in the receiving opening of the retaining element.

7. The bullet as claimed in claim 5, wherein the retaining element has a frustoconical retaining element rear, a cylindrical retaining element middle, and a retaining element front that is formed in a manner tapering conically toward the bullet axis starting from the retaining element middle in a direction of the penetrator tip.

8. The bullet as claimed in claim 7, wherein at least one of:

i) the retaining element front has a cone angle of between 10° and 20°, and i) the retaining element front has a wall thickness that decreases continuously in the direction of the penetrator tip, and iii) the retaining element rear has a frustum angle of between 5° and 15°, and iv) a diameter at the frustum end of the retaining element rear is between 9 mm and 11 mm, and v) the retaining element rear has a conical indentation, and vi) a diameter of the retaining element middle is between 12.5 mm and 13.5 mm, and vii) a lateral surface of the retaining element middle has encircling grooves.

9. The bullet as claimed in claim 7, wherein the retaining element is formed in one piece from the retaining element rear, the retaining element middle, and the retaining element front.

10. The bullet as claimed in claim 7, wherein at least one of:

i) a total length of the retaining element is between 35 mm and 55 mm, and ii) a length of the retaining element front is between 3 mm and 21 mm, and iii) a length of the retaining element middle is between 14 mm and 42 mm.

11. The bullet as claimed in claim 5, wherein, for a total bullet mass of 100%, the retaining element makes up 60% and the penetrator makes up 40% of the bullet mass.

12. The bullet as claimed in claim 1, wherein the penetrator is received entirely in the retaining element.

13. The bullet as claimed in claim 1, wherein the retaining element has a frustoconical retaining element rear, a cylindrical retaining element middle, and an ogival retaining element front, wherein the retaining element front transitions into a frustum shape or calotte shape in its front region.

14. A bullet comprising a retaining element and a penetrator, wherein the penetrator is received at least partially in a receiving opening, extending centrally relative to a bullet axis, of the retaining element, and has a penetrator front and a penetrator rear, wherein the penetrator rear is formed in a cylindrical manner and the penetrator front is formed in a manner tapering conically toward the bullet axis starting from the penetrator rear in the direction of a penetrator tip, wherein a length of the penetrator front is in a length ratio of 1 to 1, or 1 to 1.5, or 1 to 2.2, with respect to a length of the penetrator rear, wherein the retaining element comprises a retaining element rear, a retaining element middle, and a retaining element front, and wherein the retaining element middle has at its front a frustum with a cone angle, and wherein the retaining element front has at its rear an internal cone with a cone angle being identical to the cone angle of the frustum.

15. The bullet as claimed in claim 14, wherein the retaining element front, the retaining element middle, and at least regionally also the retaining element rear are encased by a casing.

16. The bullet as claimed in claim 1, wherein at least one of:

i) the casing has a greater wall thickness in the front region of the retaining element front, and ii) the casing has a notch in a region of the retaining element middle, and iii) the casing has rear-side flanging in a region of the retaining element rear.

17. The bullet as claimed in claim 13, wherein at least one of:

i) the retaining element middle has at its front a frustum with a cone angle of between 30° and 50°, and wherein the retaining element front has at its rear an internal cone with an identical cone angle and has been fitted in a form-fitting manner on the frustum, and ii) the retaining element middle extends beyond the middle of the penetrator starting from the penetrator rear in a direction of the penetrator front, and iii) the retaining element front extends beyond the penetrator tip.

18. The bullet as claimed in claim 13, wherein at least one of:

i) the retaining element rear and the retaining element middle are formed in one piece and consist of a plastic or steel, and ii) the retaining element front consists of pulverulent substances or mixtures such as borax, incendiary agents, or explosives.

19. The bullet as claimed in claim 13, wherein at least one of:

i) a total length of the retaining element is between 53 mm and 55 mm, and ii) a length of the retaining element front is between 22 mm and 28 mm, and iii) a length of the retaining element middle is between 19 mm and 25 mm, and iv) for a total bullet mass of 100%, the retaining element makes up 10%, the penetrator makes up 50%, and the casing makes up 40% of the bullet mass, and v) for a total retaining element mass of 100%, the retaining element front makes up 40%, the retaining element middle makes up 50%, and the retaining element rear makes up 10% of the retaining element mass.

20. The bullet as claimed in claim 5, wherein the penetrator front projects out of a front of the retaining element.

21. The bullet as claimed in claim 8, wherein the wall thickness is zero in a transition region between the penetrator front and the penetrator rear, such that the entire penetrator front is exposed.

22. The bullet as claimed in claim 12, wherein the penetrator is received with a precise fit in the retaining element.

23. The bullet as claimed in claim 14, wherein the retaining element has a frustoconical retaining element rear, a cylindrical retaining element middle, and an ogival retaining element front, and wherein the retaining element front transitions into a frustum shape or calotte shape in its front region.

24. The bullet as claimed in claim 23, wherein at least one of:

i) the frustum of the retaining element middle has a cone angle of between 30° and 50°, and wherein the retaining element front has been fitted in a form-fitting manner on the frustum, and ii) the retaining element middle extends beyond the middle of the penetrator starting from the penetrator rear in a direction of the penetrator front, and iii) the retaining element front extends beyond the penetrator tip.

* * * * *